United States Patent [19]

Hastings

[11] Patent Number: 4,702,018

[45] Date of Patent: Oct. 27, 1987

[54] OPEN AIR CLOTHES DRYER

[76] Inventor: Allen M. Hastings, 4700 Fawnwood Cove, Austin, Tex. 78735

[21] Appl. No.: 6,180

[22] Filed: Jan. 23, 1987

[51] Int. Cl.[4] ..... F26B 11/04

[52] U.S. Cl. ..... 34/130; 34/133; 264/248; 264/250; 29/455 R; 29/463

[58] Field of Search ..... 34/8, 58, 93, 35, 39, 34/103, 133, 130, 237, 239, 241; 264/248, 249, 250; 29/463, 455 R

[56] References Cited

U.S. PATENT DOCUMENTS

| | | | |
|---|---|---|---|
| 2,970,719 | 2/1961 | Brady | 29/463 |
| 3,357,109 | 12/1967 | Harvey | 34/133 |
| 4,189,850 | 2/1980 | Dieterich et al. | 34/58 |
| 4,201,306 | 5/1980 | Dubois et al. | 156/69 |
| 4,236,322 | 12/1980 | Hastings | 34/239 |
| 4,628,617 | 12/1986 | St Louis | 34/133 |

*Primary Examiner*—Albert J. Makay
*Assistant Examiner*—David Westphal
*Attorney, Agent, or Firm*—Walter C. Farley

[57] ABSTRACT

A clothes dryer assembly includes a drum made of two molded halves, each being perforated. The drum is mounted for rotation on a frame and enclosed within a housing also made of two molded halves and having a large number of openings for free air flow. The drum is supported on rollers on the frame and has a side door for access. A motor is mounted on the frame to drive the drum.

6 Claims, 11 Drawing Figures

OPEN AIR CLOTHES DRYER

This invention relates to an open air and solar dryer for drying articles of clothing and the like and particularly to substantial improvements therein.

BACKGROUND OF THE INVENTION

U.S. Pat. No. 4,236,322 discloses an apparatus for drying articles of clothing and the like in the open air. As shown therein, a drum of a convenient size having screen-like sides is rotatably supported on a frame. A motor mounted on the frame is coupled to the drum by a belt and rotates the drum so that the objects therein are tumbled.

It has been found that a dryer constructed as shown therein works extremely well and has numerous advantages over conventional clothes dryers which are enclosed and which use heat produced, usually, by electricity or gas. The most obvious advantage, of course, is the great saving in energy since only a small part of the power consumed by a conventional dryer is needed to turn the drum of the dryer disclosed in the above-mentioned patent. It has also been found that clothing regularly dried by tumbling along with the natural circulation of air, with or without exposure to sunlight, lasts somewhat longer and is much less subject to shrinkage and other forms of degradation which commonly result from the relatively high temperatures of a conventional dryer. Furthermore, the dryer capacity can be made much larger without meaningful additional expense; the dryer is usable to dry articles when washing items damageable by the heat of conventional dryers; it is effective to remove lint, dust and mud from clothing instead of or before washing under conditions in which most dryers would be damaged or would be subsequently unusable without disassembly and cleaning; and many articles of clothing are much more comfortable to wear after having been dried in an open air tumble dryer than after drying by any other technique.

It has been found, however, that the apparatus shown in U.S. Pat. No. 4,236,322 is not completely suitable for use under some circumstances and is difficult and expensive to manufacture. A major problem with that dryer is that the rotating drum is exposed, raising the possibility that a person, particularly a child, might be injured by inserting a hand, for example, between the drum and frame. Also, although the dryer of that patent is intended primarily for use out of doors, it has been found that it very useful indoors as well. Accordingly, some form of lint control is desirable.

SUMMARY OF THE INVENTION

Accordingly, an object of the present invention is to provide an improved drying apparatus having a rotatable drum and a housing which traps lint and the like and provides safety but does not significantly impede air flow and access to the dryer.

A further object is to provide such a dryer which can be produced in quantity at reasonable cost and which is safe and effective to use.

Briefly described, the invention comprises a clothes drying apparatus including a drum having first and second identical molded polymeric drum halves, each drum half having a generally flat wall and a perpendicular cylindrical wall terminating at a circular edge. The walls of each drum half are penetrated by a large number of holes and the circular edge is formed with means to permit the drums to be joined together to form a drying cylinder which is symmetrical about a line passing through the centers of the flat walls. Each drum half has a central opening in which a bearing can be mounted and a region which can be removed to form an access opening. The periphery of each flat wall includes means forming a groove to receive a drive belt. The apparatus also includes first and second substantially identical housing halves each having a flat wall with dimensions greater than the flat wall of the drum halves and a side wall which is generally perpendicular to the flat wall terminating at edges which are joinable to form a housing having an interior volume capable of containing the drum. Each housing half includes a substantially rigid frame portion molded into a lower portion of each housing half, each frame portion having ends which are connectable to the other frame portion and for receiving means for supporting the housing on a surface. Each housing half has a center region with means for holding a bearing and a region which is removable to form an access opening. The apparatus further includes a motor, means in the housing to support the motor and rollers to support the drum within the housing so that it is rotatable about its axis of symmetry with the access opening formed therein being substantially aligned with the access opening formed in the housing. The motor is mounted on means pivotable about an axis supported on the frame to apply tension to the belt.

The invention also includes a method of making the dryer.

In order to impart full understanding of the manner in which the above and other objects are attained in accordance with the invention, particularly advantageous embodiments thereof will be described with reference to the accompanying drawings, which form a part of this specification, and wherein.

DESCRIPTION OF PREFERRED EMBODIMENT

Figure 1:
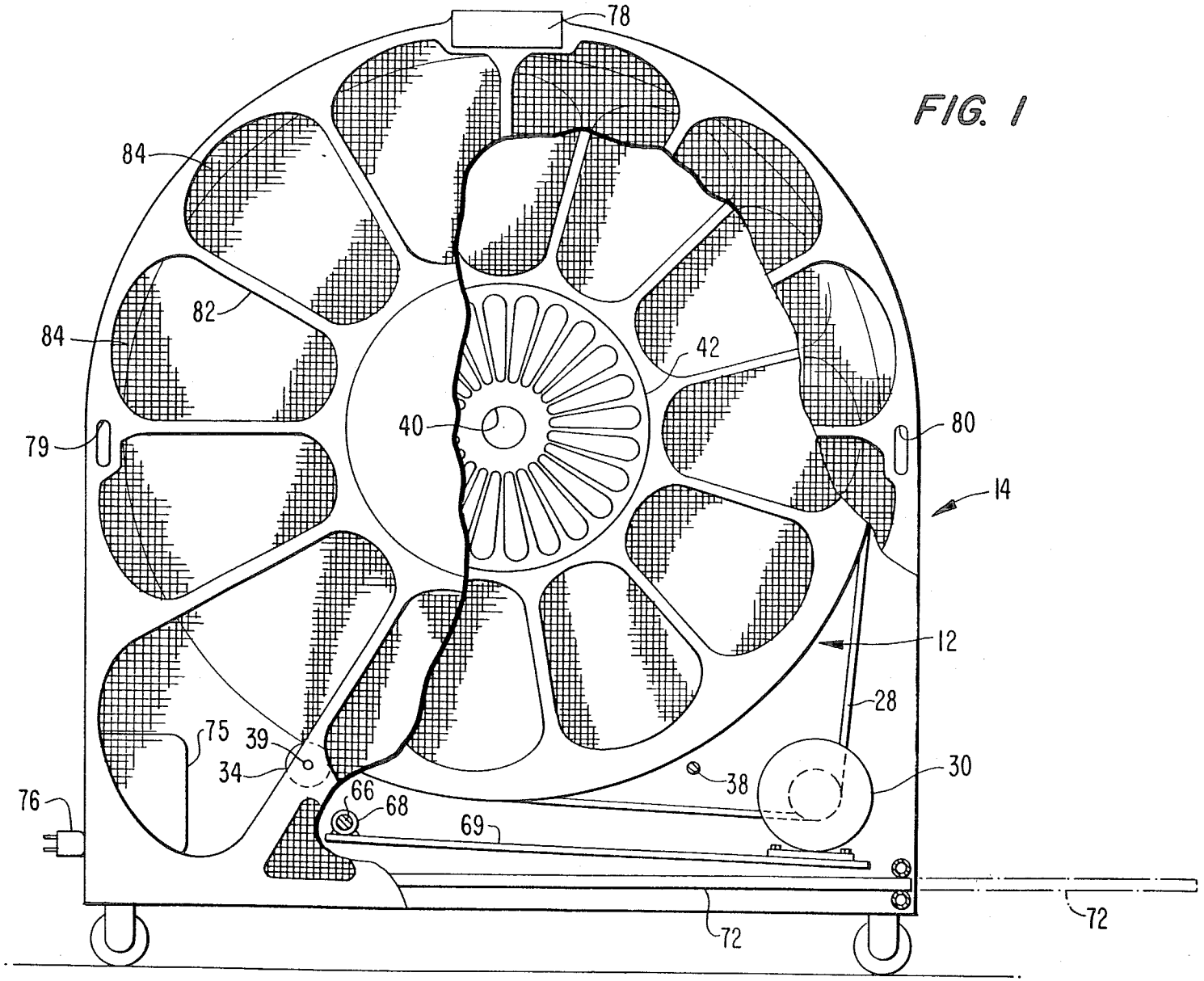
FIG. 1 is a side elevation, partly cut away, of a drying apparatus in accordance with the invention.
Figure 2:
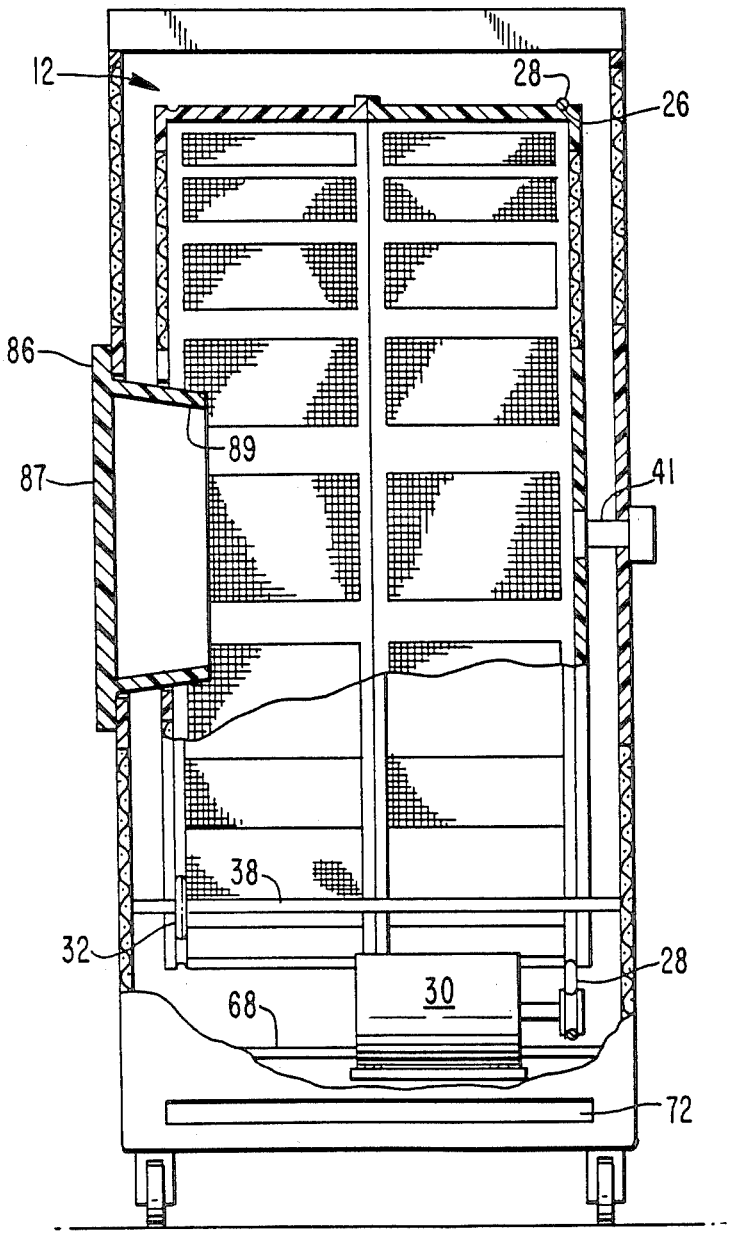
FIG. 2 is an end elevation, partly in section, of the apparatus of FIG. 1.
Figure 3:
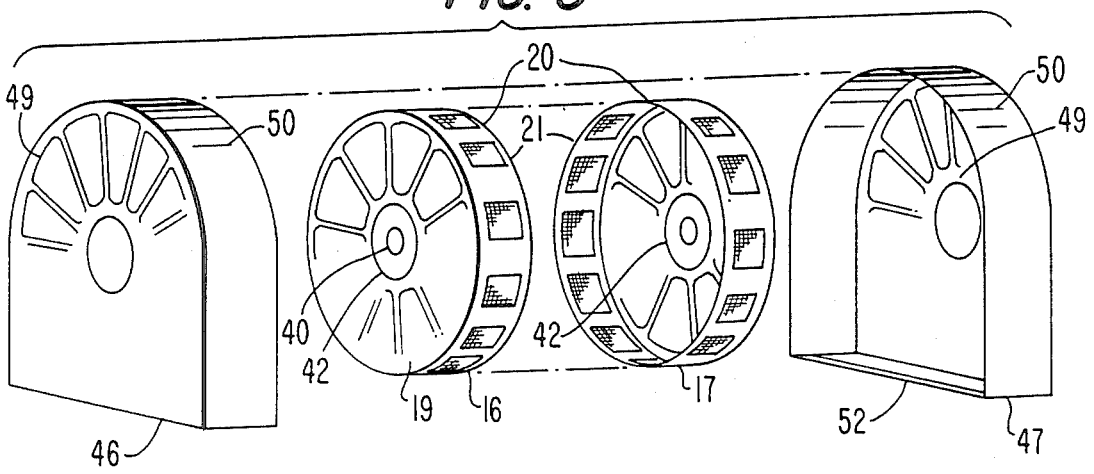
FIG. 3 is a somewhat schematic exploded view of the major components of the drum and housing of the apparatus of FIGS. 1 and 2.

The major components of the drying apparatus in accordance with the invention are shown in a basic, assembled form in FIGS. 1 and 2. As shown therein, the apparatus includes a drum indicated generally at 12 which is rotatable about a central axis of symmetry and which is contained within a housing indicated generally at 14. As shown in FIG. 3, drum 12 includes two substantially identical drum halves 16 and 17, each of which has a circular flat wall 19 and a cylindrical wall 20 which is perpendicular to wall 19 and which terminates in a circular edge 21. Each drum half is unitarily molded using a polymeric thermoplastic material such as high density polyethylene. Edges 21 are formed so that halves 16 and 17 can be fitted together and attached to each other as a single unit. Thus, the edges can include outwardly extending flanges, as shown, which can be connected together using clips or other fasteners, or the edges can be concave over 180° and convex over the other 180° so that the two halves can be joined and welded ultrasonically or adhered.

Each of the walls 19 and 20 is provided with a regular pattern of openings to permit the free passage of air therethrough and to admit light. Preferably, the openings are about 3/16"×3/16" and separated by ⅛ inch mullions, forming a mesh having about 9 openings per square inch. As best seen in FIG. 2, each drum half also has a peripheral groove 26 which, at one side of the assembled dryer, receives an endless belt 28 coupled to the pulley of a motor 30 to drive the drum. Groove 26 on the other side of the drum receives guide and support rollers 32 and 34 which are mounted on axles 38 and 39, respectively, to support a major part of the weight of the drum.

In the present embodiment, each drum half is about 42 inches in diameter, although other sizes are contemplated, and has a central opening 40 which can receive a bearing 41 as illustrated in FIG. 2 to support the other side of the drum. In addition, a solid circular region surrounding the central opening is provided to encompass a cut line 42 in each drum half to facilitate cutting and removing a relatively large circular portion of one drum half to provide an access opening about 18 inches in diameter. As will be recognized, when two drum halves are to be joined, one drum half is cut along line 42 to provide the access opening while the other drum half is left unaltered to permit installation of bearing 41.

FIG. 3 also illustrates, in somewhat simplified form, first and second housing halves 46 and 47 which are molded in a manner similar to the drum halves and are initially identical to each other. Each of the housing halves includes a flat wall 49 and a perpendicular side wall 50 which is substantially U-shaped. The bottom is provided with a brace 52 across the open end but is otherwise open. Each of walls 49 and 50 is provided with a pattern of small holes, as with the drum halves, to permit the free circulation of air. As will be readily apparent from the Figures, the flat walls 49 of the housing halves must be larger than the flat walls 19 of the drum halves so that the assembled drum can fit within the housing and rotate without interference.

Figure 4:
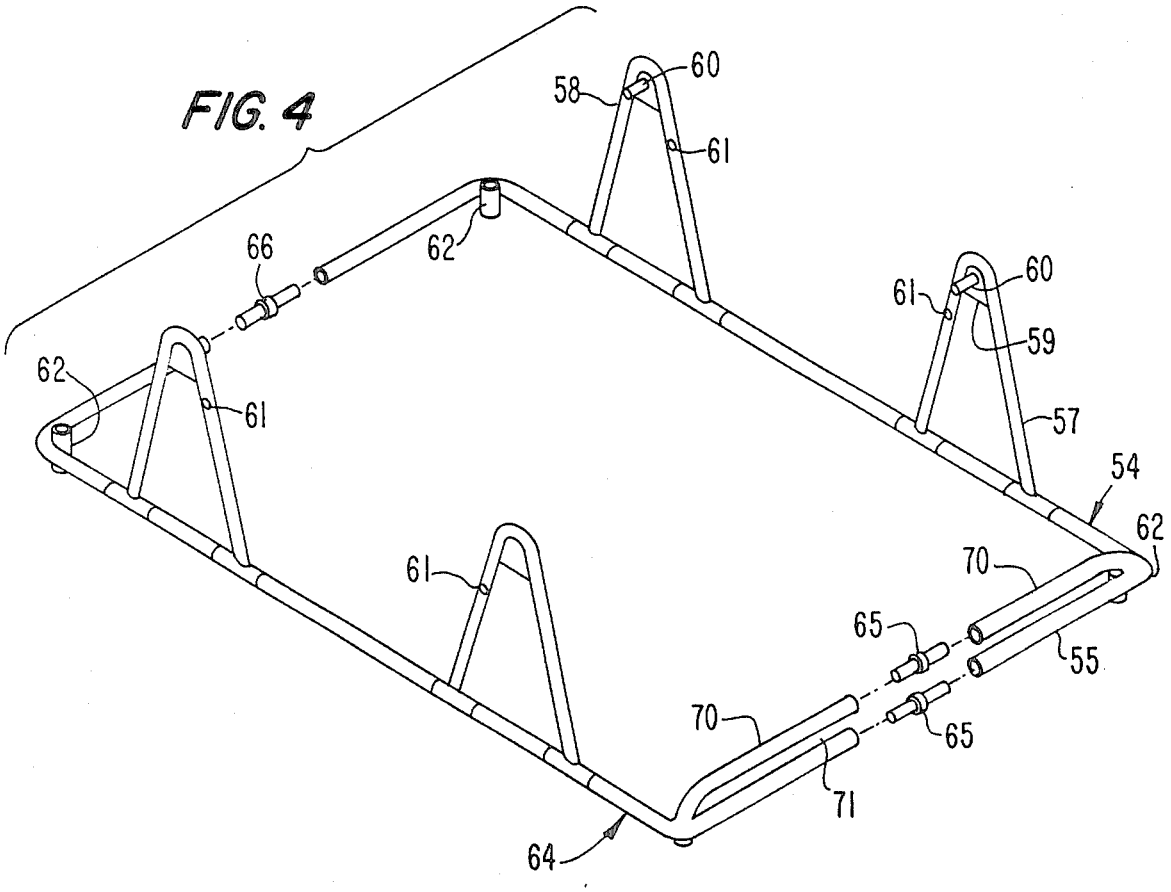
FIG. 4 is a perspective exploded view of a frame structure usable in the apparatus of FIGS. 1 and 2.

For purposes of strength and to support some of the components of the dryer, the housing halves are provided with substantially rigid frames which are molded into the lower portions of the housing halves, typical frames for this purpose being shown in FIG. 4. In the embodiment shown, metal frame members are shown, although it is believed that rigid plastic members can be employed. A frame member 54 to be molded into housing half 47 includes a generally U-shaped portion of tubular metal 55, this portion being shaped to conform to the ultimate bottom shape of the housing half. Along the mid portion of the U are additional downwardly opening V-shaped brace members 57 and 58, each of which is provided with a transverse plate 59 into which an axle socket 60 is welded. Axle sockets 60, in the assembled structure, will support axles 38 and 39 to rotatably hold rollers 32 and 34 which support the rotating drum. The frame components are shown as being made using tubular stock, although other structural shapes can be employed. At the corners of frame 54 are sockets 62 to receive caster shafts.

A frame 64, identical to frame 54, will be molded into a housing half 46. When the two housing halves are joined, coupling members 65 and 66 can be inserted in the ends of the tubular frame portions in a press fit to assist in the structural integrity of the assembly. As with the drum members, adjoining edges of the housing halves can be welded or attached by suitable fasteners. Holes 61 are provided in the braces 57 and 58 on each frame portion to receive the ends of a support rod 66 which forms part of the motor mounting. A hole is provided in each brace member so that the orientation of the frame within the housing half is unimportant.

If desired, frame members 54 and 64 can be formed with additional upper end members 70 to define a slot 71 into which a flat, lint-receiving tray 72 can be inserted as illustrated in FIG. 1, the solid line representation showing the tray inserted and the dotdash lines showing it partially extracted for cleaning.

As seen in FIG. 1, pivot rod 66 is surrounded by a sleeve 68 to which an elongated board-like member 69 is attached. Support member 69 is thus pivotable about the axis of rod 66. Motor 30 is fixedly attached to the other end of support member 69 so that the weight of the motor exerts a tensioning force on belt 28.

A spring-loaded retracting reel 75 can be mounted within the housing so that a power cord having a plug 76 can be extended and plugged into a suitable receptacle to supply power for the motor and controls. A control unit 78 is formed by molding a chamber into the housing so that suitable controls can be provided. The controls are preferably located at the top of the housing so that they will be less accessible to children. Hand holes 79 and 80 are also molded into the corners of the housing halves at suitable heights.

As illustrated in FIG. 1, the housing and drum portions are molded with patterns of openings having relative thick and heavy rib areas 82 and intermediate portions with smaller, screen-like members defining the openings. In walls 20 of the drum portions, the strength members can be closer together because those portions must support the weight of articles to be dried.

Figure 5:
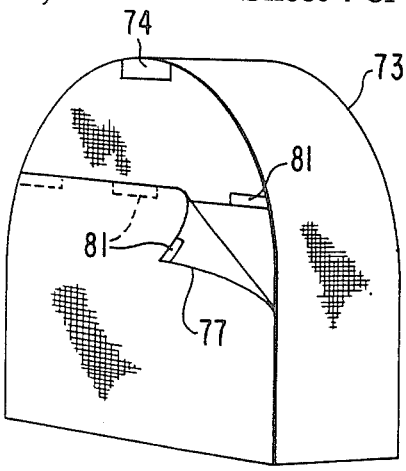
FIG. 5 is a schematic representation of a lint screen usable with the apparatus of FIG. 3.

FIG. 5 is a schematic view of a lint cover usable with the dryer structure of FIGS. 1 and 2 to permit the dryer to be used indoors without excessive lint or dust from clothing articles being dispersed around the house. The cover is a nylon or the like mesh bag 73 of suitable size and shape to generally match the exterior shape of the dryer housing. An opening 74 can be provided at the top to permit access to the control panel. Also, a cloth panel 77 can be made openable to allow access to door 86 without requiring removal of the cover. Panel 77 can be secured in place by fasteners such as VELCRO strips or patches 81. Any suitable light-weight and durable mesh fabric can be used to form the cover 73, although nylon mesh is preferred.

When the portion in the center of one of the drum halves is removed along cut line 42 to provide an axis opening, this opening is aligned with a similarly formed opening in one of the housing halves. In order to prevent the possibility of articles of clothing emerging from the drum, a separately formed door structure 86 is hingedly mounted in the opening in the housing half. The door has a circular panel 87 with a rim which can be hingedly attached to the material of the housing half adjacent the opening formed by cutting along cut line 42. An annular wall 89 protrudes from the inner side of circular portion 87 a distance greater than the distance between the housing and drum so that the wall protrudes at least into the opening in the drum, and preferably, beyond that opening into the interior of the drum a short distance. The outer surfaces of wall 89 are tapered inwardly so that any clothing which falls on the protruding portion of the door slides off and falls to the bottom of the drum. Providing protruding wall 89 prevents the possibility of an article of clothing emerging from the drum and falling between the drum and housing.

Figure 6:
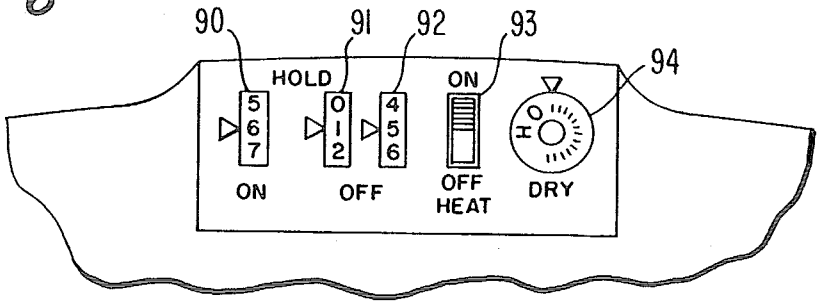
FIG. 6 is a front elevation of a control panel usable in the apparatus of FIGS. 1 and 2.

A suitable control panel is illustrated in FIG. 6, although many variations are possible depending upon the nature of the control desired. Selector switches 90, 91 and 92, shown as thumb-wheel switches, can be set to select intervals of time suitable to the control sequence. A power switch 93 controls the application of power to motor 30, and a rotatable timer switch 94 can also be employed. In one particularly useful mode of control, timer switch 94 can be rotated to select a drying time after which times selected by switches 90, 91 and 92 can be used to cycle the dryer on and off, preventing the possibility of clothing being wrinkled if the dryer is not emptied and deenergized promptly after the interval establishe the possibility of clothing being wrinkled if the dryer is not emptied and deenergized promptly after the interval established by dial 94 has expired. For example, switch 90 can be used to select an "on" time and switches 91 and 92 can be set to select an "off" time. The "HOLD" sequence can be initiated when the drying timer dial 94 reaches the "H" position at the end of the drying interval or one can simply rotate the dial to that position. This will insure that the clothes are periodically fluffed and rearranged.

Another function of the "HOLD" sequence is to permit drying clothing items in a confined area, such as a basement or utility room, over an extended time. The ON and OFF portions of the cycle allow time between drying operations for the humid air to dissipate without continuing to expend energy to operate the motor. The dryer can be operated in this intermittent fashion overnight or over a 24-hour period, as desired.

Figure 9:
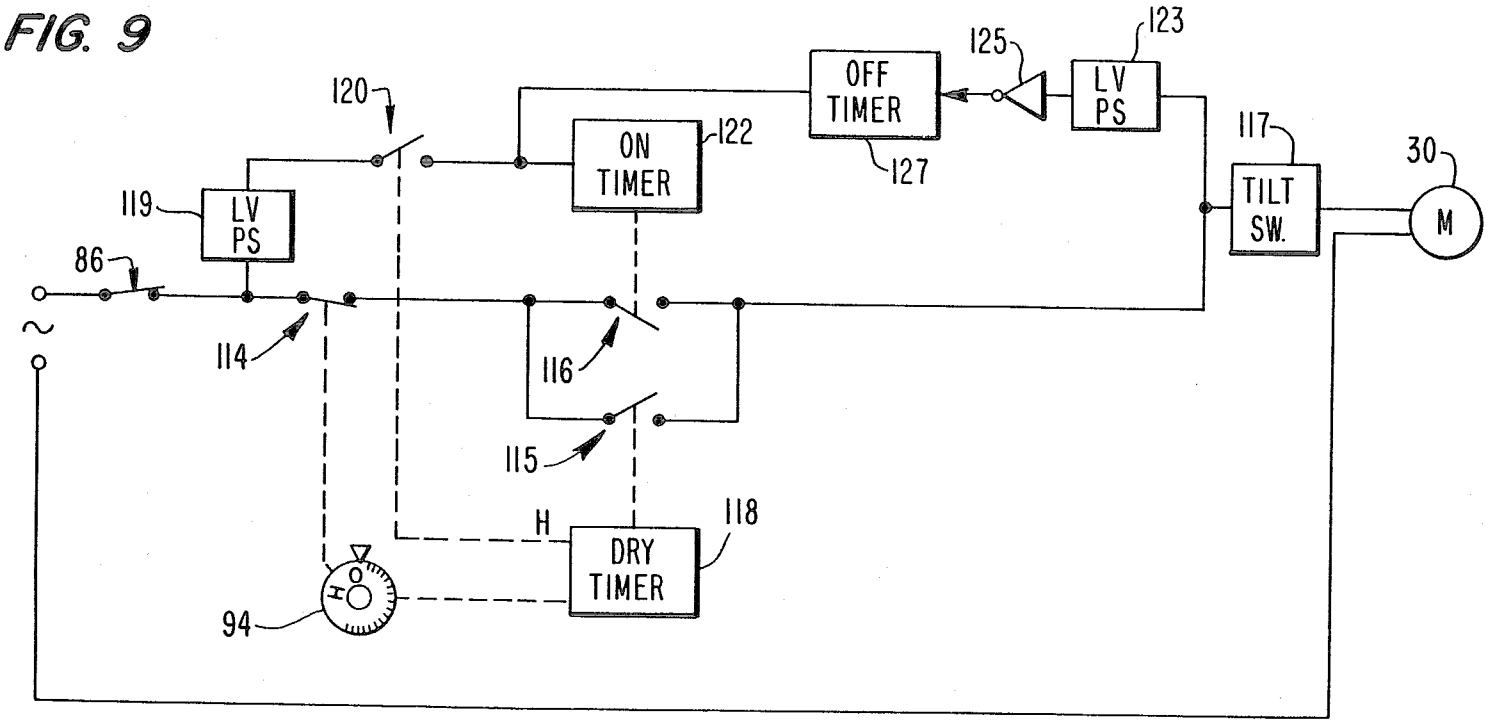
FIG. 9 is a schematic circuit diagram of a motor control circuit usable in the apparatus.

A circuit suitable for controlling the operation of the dryer is shown in FIG. 9. The AC supply, nominally 115 VAC, is connected to motor 30 and, through a door switch 112 and normally closed timer switch 114, to contact sets 115 and 116 which are normally open contact sets connected in parallel circuit relationship between the supply and, through a tilt switch 117, to the motor. Contact set 115 is operated by a dry timer 118 the functions of which are set by dial 94. Timer 118 can be any conventional timer having a motor for driving dial 94. A drying time can be set by moving dial 94 so that its calibrations show the desired time. At the end of the drying time, the dial is returned to the "H" position in which a contact set 120 is closed, either mechanically or electronically. Tilt switch 117 deenergizes the motor in the event the dryer is tilted from vertical more than e.g., 10°. Door switch 112 suspends operation of everything whenever the door 86 is open.

Contact set 120 is connected between a low voltage power source 119 and an ON timer 122 for the purpose of providing a start signal for timer 122. When a start signal is received, timer 122 closes contact set 116, energizing motor 30 for an interval determined by the setting of switch 90. At the end of that interval, contact set 116 is opened again and an initiating signal is supplied through a low voltage source 123 and an inverter 125 to an OFF timer 127. After an interval determined by the settings of switches 91 and 92, timer 127 provides an initiating signal for ON timer 122, reenergizing motor 30 for the previously selected ON interval. This cycle repeats until dial 94 is moved to the "O" or off position in which switch 114 is opened, removing power from the motor. It will be recognized that FIG. 9 shows only the signal circuits for timers 122 and 127, the power being separately supplied. These timers can advantageously be type 555 solid state devices.

Figure 10:
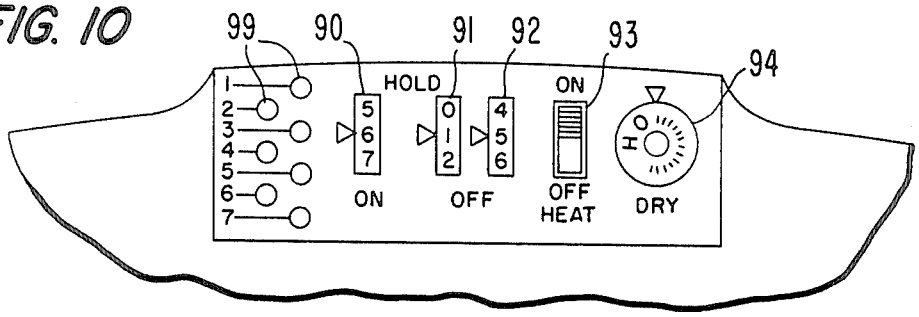
FIG. 10 is a front elevation of a further embodiment of a control panel usable in the apparatus of FIGS. 1 and 2.

As a further safety feature, the ON-OFF switch 93 can be replaced by, or combined with, a combination lock switch which requires that a specific combination be dialed or punched in before power can be supplied to the dryer motor. The combination lock switch can use thumbwheels, similar to switches 90–92, a calculator type of numeric keypad or a push button array such as that commonly used with door locks to control access to a secure room without keys. An alternative arrangement for a control panel for the dryer using this concept is shown in FIG. 10. The control panel is the same as shown in FIG. 6 except for the addition of a set of buttons 99 which, as with a security door lock, must be pushed in a preselected sequence to permit the supply of power to any part of the dryer controls. The primary purpose of this is to prevent children from creating a hazard for themselves by using the dryer without supervision.

Figure 7:
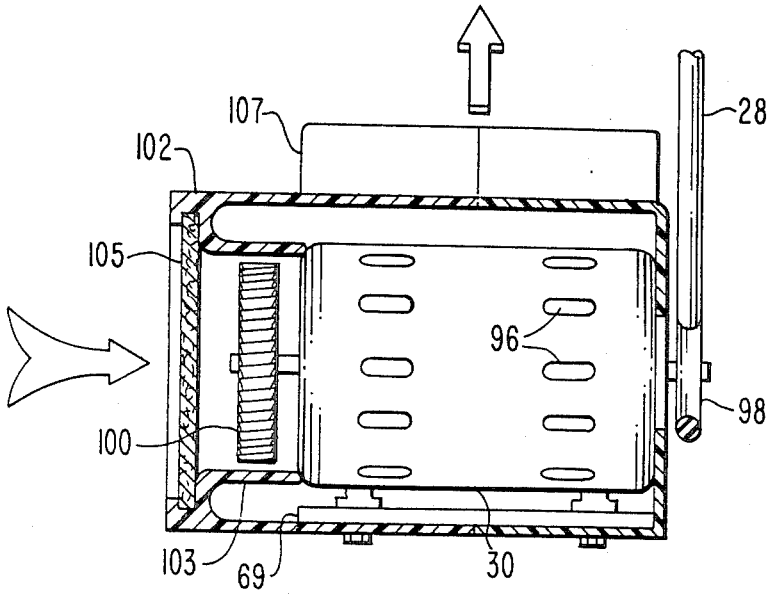
FIG. 7 is a side elevation, in section, of a further embodiment of a motor housing usable in the apparatus of FIGS. 1 and 2.
Figure 8:
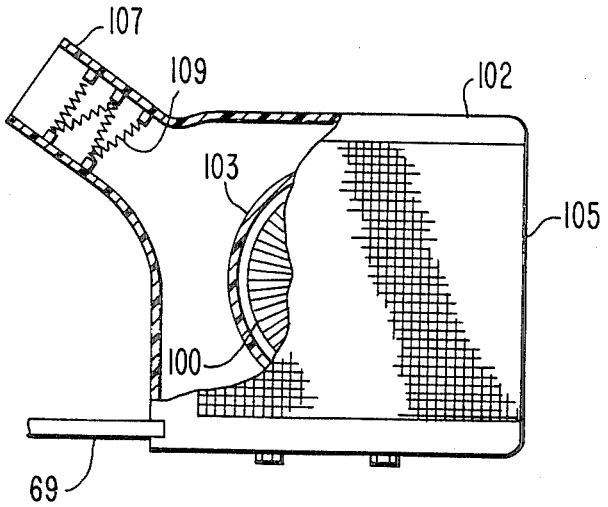
FIG. 8 is an end elevation, partly in section, of the apparatus of FIG. 8.

As previously mentioned, it has been found that drying clothing in a dryer in accordance with the invention is quite effective without the addition of supplemental heat, even in conditions of humidity which would normally not be regarded as suitable drying conditions. However, it is possible to provide the apparatus with a supplemental heating system so that the drying process can be accelerated, if desired, under conditions which will not permit the clothes to be dried normally in a desired interval. FIGS. 7 and 8 illustrate an arrangement in which the motor heat can be utilized to encourage drying and in which minimal supplemental electrical heating can also be provided in the order of 20% or less of the heating supplied to a conventional dryer. As shown therein, the motor 30 is mounted on support member 69, the exterior of motor 30 being of the type which is provided with a plurality of ventilating openings 96 for the outflow of cooling air. A pulley 98 at one end of the motor is connected to the motor output shaft and coupled by belt 28 to the drum. A ventilating fan 100 is connected to the other end of the motor shaft so that rotation of the motor draws air into the end of the motor adjacent fan 100 to cool the motor interior. As seen in FIGS. 7 and 8, the end of support member 69 and motor 30 are enclosed within a housing 102 which tightly fits the motor at the pulley end and has an inwardly extending duct 103 at the fan end to surround the fan and direct air into the motor. A filter 105 is mounted in the end of housing 102 to minimize the entry of lint or other material into the motor. Filter 105 is preferably replaceable or cleanable.

The housing also includes an output duct 107 having an open end which is directed toward the cylindrical portion of drum 12 so that heat generated by the motor and carried away by the air emerging through openings 96 is blown out of duct 107 and toward the drying clothing.

Supplemental heating can be provided by installing coils 109 within duct 107 and connecting the coils to a suitable switch 93 on the control panel. Normally, as indicated above, such coils would not be used but they are available to supply additional heat should circumstances warrant.

Figure 11:
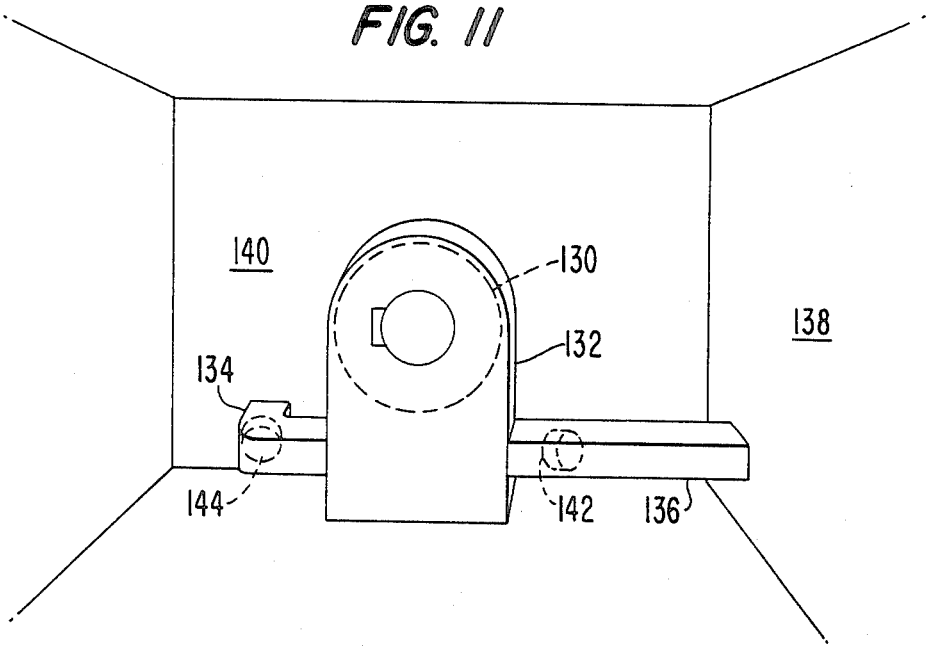
FIG. 11 is a perspective view of a further embodiment of a dryer in accordance with the invention.

FIG. 11 illustrates an embodiment which is a somewhat more permanent installation than heretofore discussed and which has certain advantages in special circumstances. As shown, the basic dryer assembly is similar in having a rotatable drum 130 enclosed within a housing 132. However, the housing 132 is solid, or is covered with a solid enclosure, to prevent significant flow of air through its walls. Instead, the housing is fitted with ducts 134 and 136 which are coupled to openings in the walls 138 and 140 of an enclosure such as a laundry room. Duct 134 has a fan 142 to draw air into housing 132 and duct 136 can have an additional fan 144 to extract air from the housing. Duct 134 can, of course, be provided with a cleanable or replaceable filter.

This embodiment has the advantage of not using any inside air from the interior of the structure for clothes drying purposes and thus avoids the heat loss which commonly results. Also, lint is conducted out of doors. The dryer is essentially isolated from the interior of the house but is nevertheless accessible.

While certain advantageous embodiments have been chosen to illustrate the invention it will be understood by those skilled in the art that various changes and modifications can be made therein without departing from the scope of the invention as defined by the appended claims.

What is claimed is:

1. A clothes dryer assembly comprising the combination of a drive motor having an output shaft;

an endless drive member;

a drum including first and second drum halves of molded polymeric material, each said drum half including a generally flat first wall and a cylindrical second wall with a circular edge, said second wall being unitarily formed on said first walls, means defining a large number of small holes passing through said first and second walls, means on said circular edge for engaging the edge of the other drum half, and an annular groove around said second wall for receiving said endless drive member;

a housing including first and second housing halves of molded polymeric material, each said housing half including a flat third wall having a larger area than each said first wall and a fourth wall unitarily formed on and perpendicular to said third wall, said fourth wall having edges shaped to mate with the other housing half, a metal bottom frame molded into a portion of said housing half, and support means attached to said metal frame for supporting said assembly;

roller means mounted on said housing for supporting said drum so that said drum is rotatable about its central axis within said housing;

means on one of said drum halves defining an access opening to permit insertion and removal of clothing to be dried;

means on one of said housing halves defining a door opening aligned with said access opening; and means on said housing for supporting said drive motor, said endless drive member being coupled to said output shaft and said drum to rotate said drum.

2. A dryer assembly according to claim 1 wherein said means for supporting said motor includes an elongated support member, means for pivotably mounting one end of said support member in said housing and below said drum, and means for mounting said motor at the other end of said support member so that the weight of said motor maintains tension on said endless drive member.

3. A dryer assembly according to claim 2 and further comprising a housing enclosing said drive motor, said housing having inlet and outlet openings, and an impeller mounted on said output shaft for drawing air into said housing through said inlet opening and into said motor for cooling said motor, said outlet opening being directed toward said drum.

4. A dryer assembly according to claim 1 and further including a bearing interconnecting the center of the other of said drum halves and the center of the other of said housing halves.

5. A method of making a dryer assembly comprising the steps of providing a drive motor having an output shaft;

providing an endless drive member;

unitarily molding first and second drum halves of polymeric material, so that each drum half includes a generally flat first wall and a cylindrical second wall with a circular edge shaped to mate with the other drum half, the second wall being perpendicular to the first wall, a large number of small holes passing through the first and second walls, and an annular groove around the second wall for receiving the endless drive member;

joining the drum halves edge-to-edge to form a drum;

unitarily molding first and second housing halves of molded polymeric material, each housing half including a flat third wall having a larger area than each first wall and a fourth wall unitarily formed on and perpendicular to the third wall, the fourth wall having edges shaped to mate with the other housing half, a metal bottom frame molded into a portion of housing half, and support means attached to the metal frame for supporting the assembly;

joining the housing halves to form a housing for containing the drum;

mounting rollers on the housing for rotatably supporting the drum;

forming an access opening in one drum half to permit insertion and removal of clothing to be dried;

providing in one housing half a door opening aligned with said access opening; and mounting the drive motor in the housing so that the endless drive member is coupled to the output shaft and the drum to rotate the drum.

6. A method according to claim 5 wherein said drum halves are identically configured when molded and wherein a circular opening is cut in the center of the first flat wall of one drum half to form the access opening.

* * * * *